US008011042B1

(12) United States Patent
Rose et al.

(10) Patent No.: US 8,011,042 B1
(45) Date of Patent: Sep. 6, 2011

(54) ORGANIZATIONAL DEVICE

(75) Inventors: Gretchen Rose, Dallas, TX (US); Kathy Touchstone, Dallas, TX (US)

(73) Assignee: Gretchen A. Rose, Dallas, TX (US)

( * ) Notice: Subject to any disclaimer, the term of this patent is extended or adjusted under 35 U.S.C. 154(b) by 336 days.

(21) Appl. No.: 12/259,872

(22) Filed: Oct. 28, 2008

Related U.S. Application Data

(60) Provisional application No. 60/984,479, filed on Nov. 1, 2007.

(51) Int. Cl.
*A47C 15/00* (2006.01)
*A47G 9/06* (2006.01)

(52) U.S. Cl. ..... 5/653; 5/656; 5/657; 297/219.1

(58) Field of Classification Search ..... 5/417, 420, 5/653, 656, 657; 297/219.1
See application file for complete search history.

(56) References Cited

U.S. PATENT DOCUMENTS 2,340,139 A 1/1944 Norford
2,823,034 A 2/1958 Bingham, Jr.
2,865,433 A * 12/1958 Warner ..... 383/25
3,334,556 A 8/1967 Owen
4,190,918 A * 3/1980 Harvell ..... 5/653
4,843,662 A * 7/1989 Handelman ..... 5/653
4,854,637 A * 8/1989 McCree ..... 297/188.2
D357,609 S * 4/1995 Webb et al. ..... D6/596
6,005,482 A 12/1999 Moran et al.
6,058,535 A * 5/2000 Firkins et al. ..... 5/653
6,202,235 B1 * 3/2001 Salhanick ..... 5/653
6,691,356 B1 * 2/2004 Coma ..... 5/722
7,096,544 B2 8/2006 Lusardi
7,774,880 B1 * 8/2010 Botts ..... 5/656

* cited by examiner

*Primary Examiner* — Michael Trettel

(57) ABSTRACT

An organizational device for use with a group of children comprising a substantially-rectangular flexible mat having opposed first and second ends, a length, and a width. In a preferred embodiment, the substantially-rectangular flexible mat has a first plurality of substantially-rectangular areas distributed along the length and a corresponding first plurality of identification pockets affixed to the first plurality of substantially-rectangular areas. In another aspect, the substantially-rectangular flexible mat has at least one end anchoring device coupled to each of the first and second ends wherein the at least one end anchoring device is configured to removably couple to a fixed object. The present invention also provides a method of manufacturing an organizational device for use with a group of children.

20 Claims, 5 Drawing Sheets

ORGANIZATIONAL DEVICE

CROSS-REFERENCE TO RELATED APPLICATION

This Application claims the benefit of U.S. Provisional Application Ser. No. 60/984,479 filed on Nov. 1, 2007, entitled "KIDZMAT," commonly assigned with the present invention and incorporated herein by reference.

TECHNICAL FIELD OF THE INVENTION

The present invention is directed, in general to an organization device and more specifically, to a placement device for organizing young children for orderly participation in sports, games, etc.

BACKGROUND OF THE INVENTION

Children's teams, e.g., T-ball, soccer, baseball, basketball usually involve a number of members of a team, all of whom do not play at the same time. Therefore, some team members may be unoccupied while not playing. It is well known that young children, and even some older ones, do not necessarily have an attention span that keeps them focused on the game. Often they will mill about talking to friends or doing something totally unrelated to the game in progress. When time comes for them to play, e.g., to bat in T-ball, the child may have wandered away from the team holding area and therefore not be readily available, thereby delaying the game. Of course, this problem is not limited to team sports, but is also evident whenever a number of children are in need of organization, such as: schools, churches, youth organizations, summer camps, etc.

Accordingly, what is needed in the art is a device that encourages each of the members of a children's team to sit at, or stand in front of, a specified place, as well as a place to store their personal items, thus organizing multiple children participating in any event.

SUMMARY OF THE INVENTION

To address the above-discussed deficiencies of the prior art, the present invention provides an organizational device for use with a group of children comprising a substantially-rectangular flexible mat having opposed first and second ends, a length, and a width. In a preferred embodiment, the substantially-rectangular flexible mat has a first plurality of substantially-rectangular areas distributed along the length and a corresponding first plurality of identification pockets affixed to the first plurality of substantially-rectangular areas. In another aspect, the substantially-rectangular flexible mat has at least one end anchoring device coupled to each of the first and second ends wherein the at least one end anchoring device is configured to removably couple to a fixed object. The present invention also provides a method of manufacturing an organizational device for use with a group of children.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention.

Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

For the purposes of this discussion, the invention will be discussed with reference to a sports team where needed. However, one who is of skill in the art will realize that the invention may be configured differently for other specific functions involving a group of children, such as: school, theater, Bible study, etc. Furthermore, the discussion will refer to several pluralities of elements of the invention. Some of these pluralities may be identical in number to other elements, but others may differ in number. One who is of skill in the art will understand the differences. Not all of any given plurality will be shown in the accompanying FIGUREs for the sake of space.

Figure 1:
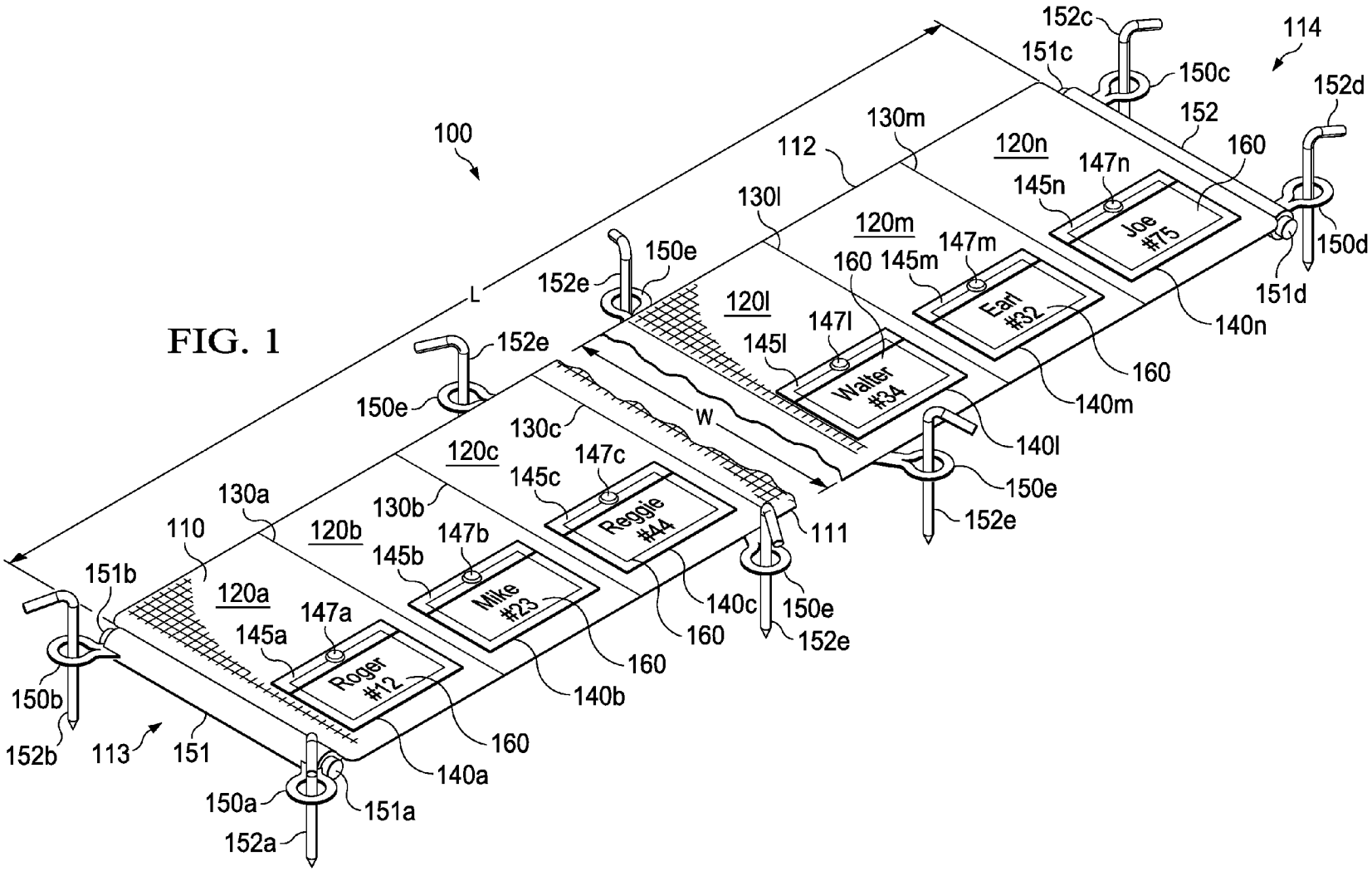
FIG. 1 illustrates an isometric view of one embodiment of an organizational device for use with a group of children constructed according to the principles of the present invention.

Referring initially to FIG. 1, illustrated is an isometric view of one embodiment of an organizational device 100 for use with a group of children constructed according to the principles of the present invention. The organizational device 100 comprises a substantially-rectangular, flexible mat 110, a first plurality of substantially-rectangular areas 120*a*-120*n*, a second plurality of visible dividers 130*a*-130*m*, a corresponding first plurality of identification pockets 140*a*-140*n*, and end anchoring devices 151, 152. The mat 110 is preferably of a flexible material such as: canvas, ground cloth, tent floor material, vinyl, or other durable, sheet-like material that can be readily rolled into a cylindrical shape. The flexible mat 110 has a length l and a width w with opposed first and second long edges 111, 112 and opposed first and second ends 113, 114. In a preferred embodiment, the flexible mat 110 should be waterproof or, at least, water repellant. This provides at least minimal protection for the children from wet or damp ground where benches or chairs are not available. The plurality of substantially-rectangular areas 120*a*-120*n* is distributed along the length l of the flexible mat 110. The plurality of substantially-rectangular areas 120*a*-120*n* is customizable for a number n that is normally at least equal to the number of players on a team of the type of sport being played. Of course, a single organizational device 100 does not have to provide for all members of a team. That is, more than one organizational device 100 may be used in order to provide a space for each active player, second string, and backup, etc. The second plurality of visible dividers 130*a*-130*m* is sufficient to provide equal areas 120*a*-120*n* for each of the players. The second plurality of visible dividers 130*a*-130*m* may be stitching, paint, printed lines, contrasting tape, or any other suitable differentiation of adjacent areas 120*a*-120*n* that will not prevent the flexible mat 110 from being rolled up, or even folded by the user if so desired.

In one embodiment, the substantially-rectangular, flexible mat 110 has a width w of about 26 inches and each of the substantially-rectangular areas 120*a*-120*n* measures about 20 inches along the length l of the flexible mat 110. The substantially-rectangular areas 120*a*-120*n* may also be termed player locations 120*a*-120*n*. In one embodiment the organizational device 100 may provide 15 player locations, for example, for a total length l of about 25 feet. The first plurality of substantially-rectangular areas 120*a*-120*n* has a corresponding first plurality of identification pockets 140*a*-140*n* affixed thereto. In a preferred embodiment, the plurality of identification pockets 140*a*-140*n* comprises a flexible, transparent medium, e.g., clear vinyl, or other similar material, that allows a card 160 having the child's name or number to be readily visible when placed therein. The plurality of identification pockets 140*a*-140*n* may be affixed to the mat 110 material by any suitable means, e.g., stitching, adhesive, hook and loop fasteners, etc. In one embodiment, the plurality of identification pockets 140*a*-140*n* may be about 6.5 inches by 9.5 inches that is sufficient to readily accept an identifying card 160, e.g., 5 inches by 8 inches, with the child's name or number printed thereon. Each of the plurality of identification pockets 140*a*-140*n* may have a fold over flap 145*a*-145*n* and snap 147*a*-147*n* for closing to prevent loss of the identifying card 160.

In one embodiment, the end anchoring devices 151, 152 may be elongated end weights 151, 152 that may provide stiffness across the ends of the organizational device 100 and additionally are of sufficient weight to hold the organizational device 100 down against the force of at least a moderate wind, as well as to resist movement of the organizational device 100 by repeated motion of the children. Optionally, the end anchoring devices 151, 152 may be a plurality of loops 150*a*-150*d* attached to the corners 151*a*-151*d* of the organizational device 100. These loops 150*a*-150*d* may comprise rope, heavy cord, canvas material, or the like, and be used with stakes 152*a*-152*d* to fasten the organizational device 100 temporarily to the earth. Additionally, the organizational device 100 may comprise loops 150*e* spaced apart along the long edges 111, 112 for use with stakes 152*e*. This embodiment is preferred for use in areas without the availability of benches.

Figure 2:
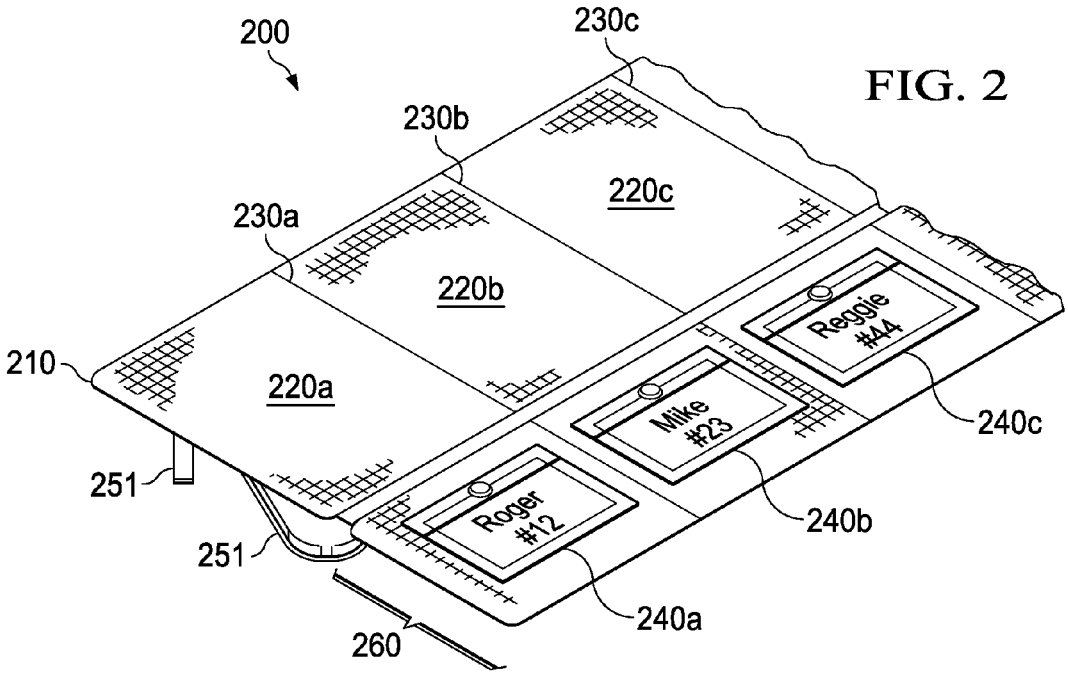
FIG. 2 illustrates a partial isometric view of a second embodiment of an organizational device intended for use with standard wooden or metal benches.

Referring now to FIG. 2, illustrated is a partial isometric view of a second embodiment of an organizational device 200 intended for use with standard wooden or metal benches (not shown). The organizational device 200 comprises a substantially-rectangular mat 210, a first plurality of substantially-rectangular areas 220*a*-220*n*, a second plurality of visible dividers 230*a*-230*m*, a corresponding first plurality of identification pockets 240*a*-240*n*, first and second end anchoring devices 251, 252 (252 not shown), and a front flap 260. The substantially-rectangular mat 210, first plurality of substantially-rectangular areas 220*a*-220*n*, second plurality of visible dividers 230*a*-230*m*, and corresponding first plurality of identification pockets 240*a*-240*n* may be of the same materials and similar construction as specified above for the organizational device 100 of FIG. 1. The front flap 250 may be made contiguous with and of the same material as the first plurality of substantially-rectangular areas 220*a*-220*n*. In this embodiment, the front flap 250 is used to mount the corresponding first plurality of identification pockets 240*a*-240*n*.

Each substantially-rectangular area 220*a*-220*n* has a corresponding identification pocket 240*a*-240*n*. The first plurality of identification pockets 240*a*-240*n* are similar to those described above, but are smaller to accommodate the smaller seating areas 220*a*-220*n*; that is, the plurality of pockets 240*a*-240*n* may be only about 6 inches by 9 inches, yet sufficient to accept an identifying card with each child's name or number printed thereon.

Figure 3:
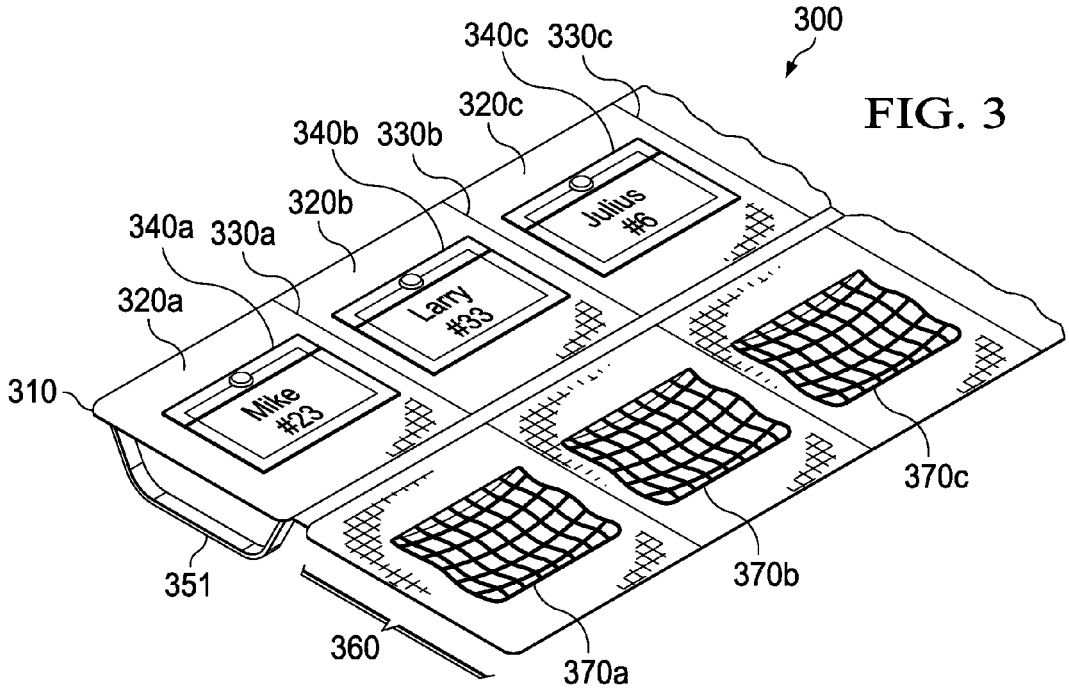
FIG. 3 illustrates a partial isometric view of a third embodiment of an organizational device intended for use with standard wooden or metal benches.

Referring now to FIG. 3, illustrated is a partial isometric view of a third embodiment of an organizational device 300 intended for use with standard wooden or metal benches (not shown). The organizational device 300 comprises a substantially-rectangular mat 310, a first plurality of substantially-rectangular areas 320*a*-320*n*, a second plurality of visible dividers 330*a*-330*m*, a corresponding first plurality of identification pockets 340*a*-340*n*, first and second end anchoring devices 351, 352 (352 not shown), a front flap 360, and a corresponding first plurality of mesh pouches 370*a*-370*n*. The substantially-rectangular mat 310, first plurality of substantially-rectangular areas 320*a*-320*n*, second plurality of visible dividers 330*a*-330*m*, and corresponding first plurality of identification pockets 340*a*-340*n* may be of the same materials and similar construction as specified above for the organizational device 100 of FIG. 1. In this embodiment, the corresponding first plurality of mesh pouches 370*a*-370*n* is attached to the front flap 360 on the front face thereof. The mesh pouches 370*a*-370*n* may be used to hold a water bottle, or other small object(s) for the individual player.

Figure 4:
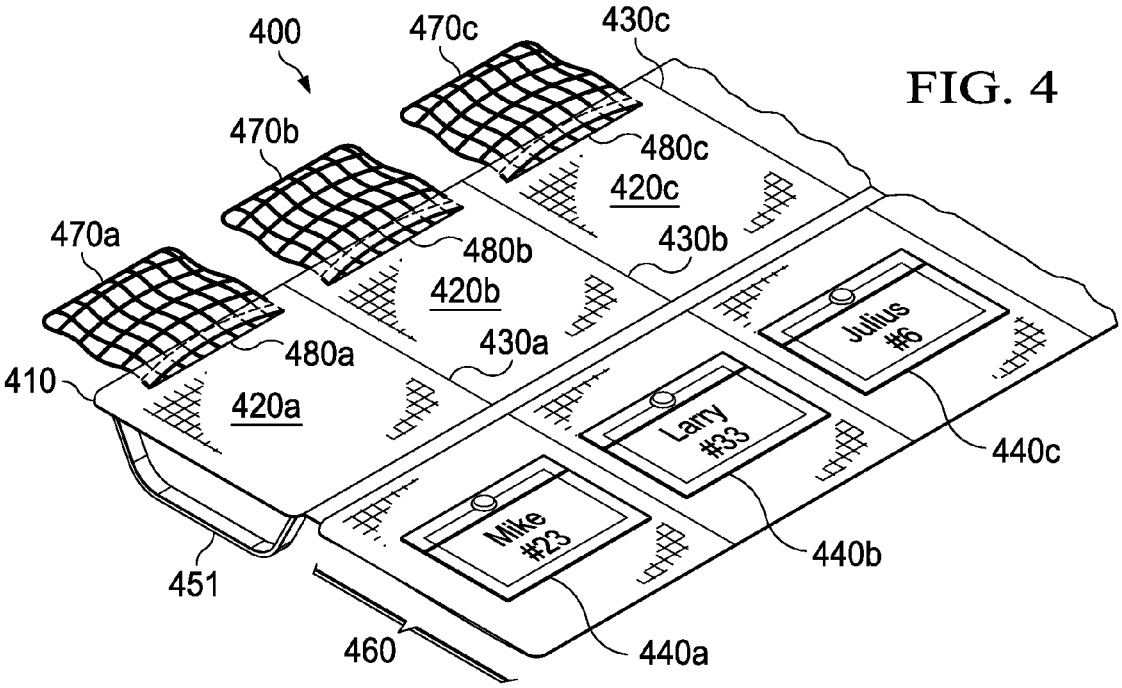
FIG. 4 illustrates a partial isometric view of a fourth embodiment of an organizational device intended for use with standard wooden or metal benches.

Referring now to FIG. 4, illustrated is a partial isometric view of a fourth embodiment of an organizational device 400 intended for use with standard wooden or metal benches (not shown). The organizational device 400 comprises a substantially-rectangular mat 410, a first plurality of substantially-rectangular areas 420*a*-420*n*, a second plurality of visible dividers 430*a*-430*m*, a corresponding first plurality of identification pockets 440*a*-440*n*, first and second end anchoring devices 451, 452 (452 not shown), a front flap 460, and a corresponding first plurality of mesh pouches 470*a*-470*n*. The substantially-rectangular mat 410, first plurality of substantially-rectangular areas 420*a*-420*n*, second plurality of visible dividers 430*a*-430*m*, corresponding first plurality of identification pockets 440*a*-440*n*, and corresponding first plurality of mesh pouches 470*a*-470*n* may be of the same materials and similar construction as specified above for the organizational device 300 of FIG. 3. In this embodiment, the corresponding first plurality of mesh pouches 470*a*-470*n* is attached to a rear edge of the substantially-rectangular mat 410. Access to the corresponding first plurality of mesh pouches 470*a*-470*n* is through a corresponding first plurality of apertures 480*a*-480*n* through the substantially-rectangular mat 410. The plurality of mesh pouches 470*a*-470*n* may have an opening of about 4 inches diameter and a depth of about 6 inches for holding the child's water bottle of other small equipment item. The first plurality of mesh pouches 470*a*-470*n* may be of an open weave of about ½ inch square so as to hold the water bottle, but eliminate the collection of debris.

Figure 5A:
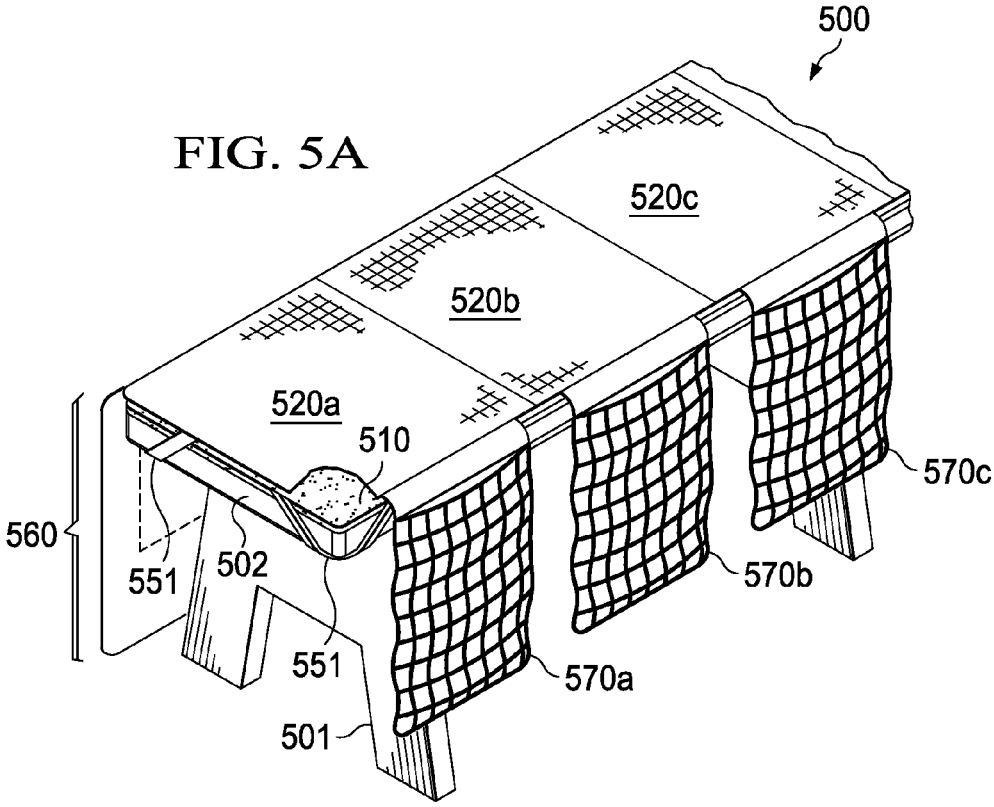
FIG. 5A illustrates a partial isometric rear view of a fifth embodiment of an organizational device intended for use with standard wooden or metal benches.

FIG. 5A illustrates a partial isometric rear view of a fifth embodiment of the organizational device when used with a bench 501. In this view, the organizational device 500 rests upon an optional foam pad 510 which rests, in turn, on a seat 502 of the bench 501. Standard athletic benches, i.e., baseball, T-ball, softball, football, etc., commonly measure about 7 inches wide by about 7.5 feet long. Because the organizational device 500 is intended for use with these standard athletic benches, the individual seating areas and the overall mat width and length must be adjusted. The seating areas 520*a*-520*n* are about 8 inches deep to cover the seat 502 of the bench 501, with a frontal flap 560 of about 4 inches height hanging from the front of the bench 501. Only the 8 inch deep seating area 520*a*-520*n* has the optional foam pad 510 to assist in holding the organizational device 500 in place on the bench 501. The foam pad 510 may be permanently affixed to the organizational device 500 or may be temporarily affixed with hook and loop fasteners (not shown), or other means as will be understood by one who is of skill in the art. The preferred embodiment will be with a separate foam pad 510, as this will more readily enable rolling the organizational device 500 for storage. Additionally, corner loops of elastic 551 may be used to slip under corners of the bench seat 502. Alternatively, a single elastic loop or drawstring ties may be used to attach the organizational device 500 to the bench 501. The frontal flap 560 and seating areas 520*a*-520*n* may be formed from a continuous piece of the material as cited above. The plurality of areas 520*a*-520*n* is customizable for the length of the bench 501, with the most practical proportion being 18 inches measured along the bench 501 which yields five areas for each 7.5° bench. The plurality of mesh pouches 570*a*-570*n* may be individually larger in this embodiment, i.e., extending the width of each seating area 520*a*-520*n*, thus enabling the stowage of more than a single small item, e.g., water bottle, fielder's glove, etc. This embodiment is preferred for use in areas with benches.

Figure 5B:
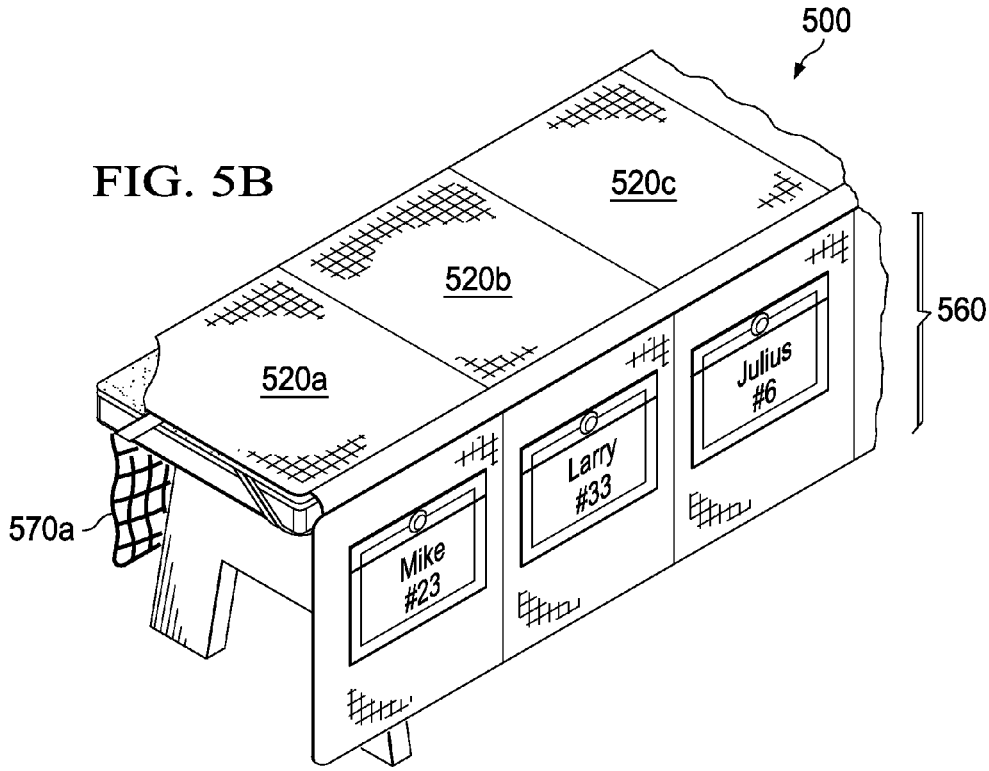
FIG. 5B illustrates a partial isometric view of the organizational device of FIG. 3 when used with a bench.

FIG. 5B illustrates a partial isometric frontal view of the organizational device 500 of FIG. 5A when used with a bench 501. One who is of skill in the art will understand the implementation of this embodiment in view of the foregoing.

Figure 5C:
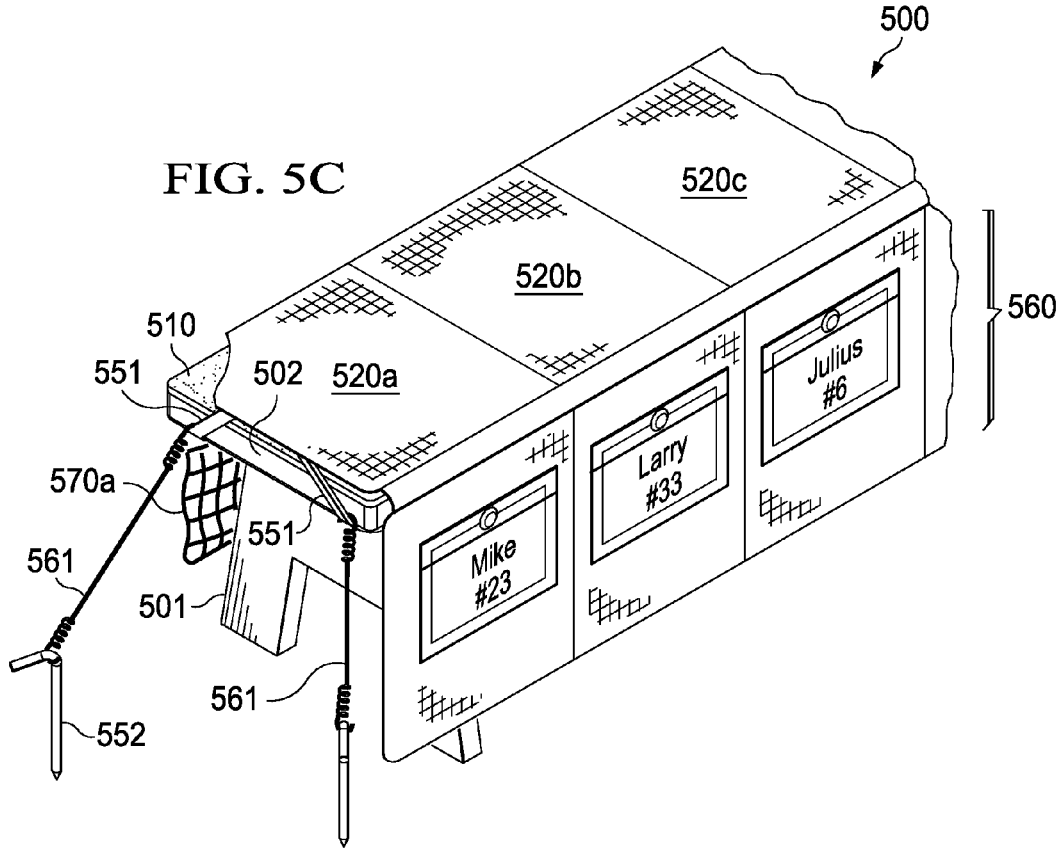
FIG. 5C illustrates a partial isometric view of the organizational device of FIG. 3 when used with a bench with optional tie downs.

FIG. 5C illustrates a partial isometric frontal view of the organizational device 500 when used with a bench 501 with optional tie downs. When the organizational device 500 is used on a bench 501, a plurality of bungee cords 561 may be interposed the loops 551 and stakes 552 driven into earth. Alternatively, removable clips (not shown) each equipped with an eyelet may be provided for use when the organizational device 500 is longer than the bench available. The removable clips may be attached anywhere along the length l of the organizational device 500 to accommodate the shorter bench. The excess length of the organizational device 500 may be folded under the useable portion of the organizational device 500 or may be rolled up and secured by tying to the bench.

In practice, the coach or other team organizer will determine the seating order for the children in the activity or sport. That seating order will be reflected by inserting appropriate identification cards marked with the particular child's name or number in the identification pockets of the organizational device 100-500 in the order desired. The children would then be instructed to sit or stand, as appropriate, on or near their identification cards when they are not actively engaged in the activity. Thus, the children will be readily available when their turn to play or perform comes.

Figure 6:
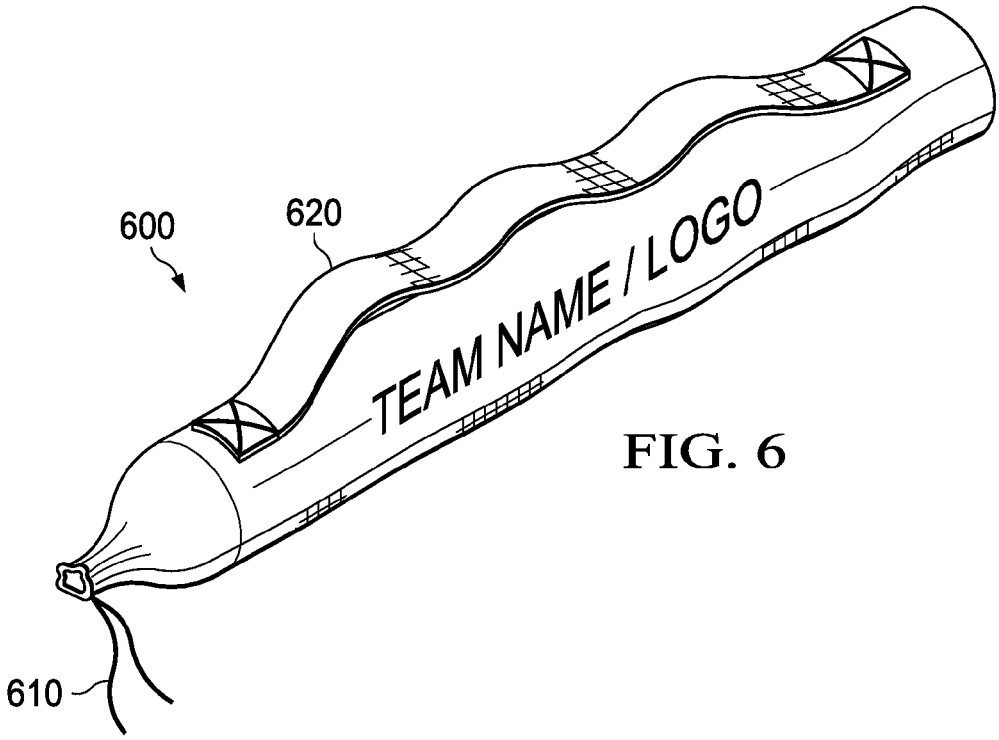
FIG. 6 illustrates a storage and transportation bag constructed according to the principles of the present invention.

Referring now to FIG. 6, illustrated is an isometric view of a storage and transportation bag 600 constructed according to the principles of the present invention. The organizational devices 100-500 may come with the storage and transportation bag 600 that accepts the organizational device 100-500 when rolled up. The storage and transportation bag 600 has a drawstring 610 closure and a shoulder sling 620 for convenient carry. The transportation bag 600 may be made from any suitable material, especially the same material as the organizational device. A similar transportation bag (not shown) may also be provided for the foam pad 510. The organizational device 100-500 may be stenciled or printed with any of a variety of symbols related to the team or the sport/activity for which it is used, e.g., baseballs, bats, soccer balls, basketballs, etc. Additionally, the organizational devices 100-500 may be produced in team colors and with team logos or specific customized features or ornamentation. Alternatively, the organizational device 100-500 may be secured with ties when rolled up as is well known in the art.

For the purposes of this discussion, use of the terms "providing" and "forming" includes: manufacture, subcontracting, purchase, etc.

Although the present invention has been described in detail, those skilled in the art should understand that they can make various changes, substitutions and alterations herein without departing from the spirit and scope of the invention in its broadest form. Furthermore, sizes as stated above are not limiting and may be adjusted for specific installations.

What is claimed is:

1. An organizational device for use with a group of children, comprising:

a substantially-rectangular flexible mat having opposed first and second ends, opposed first and second long edges, a length, and a width;

a plurality of substantially-rectangular areas distributed along said length;

a corresponding plurality of identification pockets affixed to said plurality of substantially-rectangular areas;

at least one end anchoring device coupled to each of said first and second ends; and a corresponding plurality of mesh bags coupled to and distributed along a rear edge of said substantially-rectangular flexible mat, each of said plurality of corresponding mesh bags aligning with a corresponding one of said plurality of substantially-rectangular areas.

2. The organizational device as recited in claim 1 further comprising a plurality of visible dividers coupled to said substantially-rectangular flexible mat and spaced apart along said length to define said plurality of substantially-rectangular areas.

3. The organizational device as recited in claim 1 wherein said at least one end anchoring device is configured to removably couple to a fixed object, and wherein said fixed object is earth; and further comprising a stake for at least partial insertion into said earth, said stake further coupleable to said at least one end anchoring device.

4. The organizational device as recited in claim 3 wherein said at least one end anchoring device is at least one loop and further comprising a bungee cord removably coupleable between said at least one loop and said at least one stake.

5. The organizational device as recited in claim 1 wherein said fixed object is a bench having a seat and wherein said at least one end anchoring device is a loop or a drawstring configured to encircle at least a part of said seat.

6. The organizational device as recited in claim 1 further comprising at least one side anchoring device coupled to at least one of said opposed first and second long edges.

7. The organizational device as recited in claim 1 further comprising:

a corresponding plurality of rear flaps extending from at least one of said first and second long edges and along said length; and and wherein said corresponding plurality of rear flaps further comprise a corresponding plurality of access apertures through said corresponding plurality of rear flaps for access to said corresponding plurality of mesh bags coupled to said rear edge.

8. The organizational device as recited in claim 1 further comprising a pad coupleable to said substantially-rectangular flexible mat on an underside thereof.

9. The organizational device as recited in claim 1 wherein said corresponding first plurality of identification pockets comprise a flexible, transparent medium.

10. The organizational device as recited in claim 1 wherein said substantially-rectangular flexible mat is waterproof or water repellant.

11. A method of manufacturing an organizational device for use with a group of children, comprising:

providing a substantially-rectangular flexible mat having opposed first and second ends, opposed first and second long edges, a length, and a width;

forming a plurality of substantially-rectangular areas distributed along said length;

affixing a corresponding plurality of identification pockets to said first plurality of substantially-rectangular areas;

coupling an at least one end anchoring device to each of said first and second ends; and coupling a corresponding plurality of mesh bags to a rear edge of said substantially-rectangular flexible mat and distributing said corresponding plurality of mesh bags along said length at said plurality of substantially-rectangular areas, each of said plurality of corresponding mesh bags aligning with a corresponding one of said plurality of substantially-rectangular areas.

12. The method as recited in claim 11 further comprising coupling and spacing apart along said length a plurality of visible dividers to said substantially-rectangular flexible mat to define said plurality of substantially-rectangular areas.

13. The method as recited in claim 11 wherein said at least one end anchoring device is configured to removably couple to a fixed object, wherein said fixed object is earth; and further comprising providing a stake for at least partial insertion into said earth, said stake further coupleable to said at least one end anchoring device.

14. The method as recited in claim 13 wherein coupling said at least one end anchoring device includes coupling at least one loop and further comprising providing a bungee cord removably coupleable between said at least one loop and said at least one stake.

15. The method as recited in claim 11 wherein said fixed object is a bench having a seat and wherein coupling said at least one end anchoring device includes coupling at least one loop or one drawstring, and configuring said at least one loop or said one drawstring to encircle at least a part of said seat.

16. The method as recited in claim 11 further comprising coupling at least one side anchoring device to at least one of said opposed first and second long edges.

17. The method as recited in claim 11 further comprising:

forming a corresponding plurality of rear flaps extending from at least one of said first and second long edges and along said length; and forming a corresponding plurality of access apertures through said corresponding plurality of rear flaps for access to said corresponding plurality of mesh bags coupled to said rear edge, each of said plurality of corresponding mesh bags aligning with a corresponding one of said plurality of substantially-rectangular areas.

18. The method as recited in claim 11 further comprising providing a pad coupleable to said substantially-rectangular flexible mat on an underside thereof.

19. The method as recited in claim 11 wherein said affixing includes affixing said corresponding plurality of identification pockets comprising a flexible, transparent medium.

20. The method as recited in claim 11 wherein said providing includes providing said substantially-rectangular flexible mat that is waterproof or water repellant.

* * * * *